US005339719A

United States Patent [19]

Wasser

[11] Patent Number: 5,339,719

[45] Date of Patent: Aug. 23, 1994

[54] PROCESS FOR SEATING A TONE HOLE PAD

[75] Inventor: Steven A. Wasser, Wellesley, Mass.

[73] Assignee: Verne Q. Powell Flutes, Inc., Waltham, Mass.

[21] Appl. No.: 877,906

[22] Filed: May 1, 1992

[51] Int. Cl.[5] ..... G10D 7/08

[52] U.S. Cl. ..... 84/385 P

[58] Field of Search ..... 84/385 P

[56] References Cited

U.S. PATENT DOCUMENTS

| | | | |
|---|---|---|---|
| 3,623,391 | 11/1971 | Nagao | 84/385 P |
| 3,767,506 | 10/1973 | Kawakami | 84/385 P |
| 4,114,500 | 9/1978 | Norbeck | 84/385 P |
| 4,158,979 | 6/1979 | Suzuki | 84/385 P |
| 4,704,939 | 11/1987 | Straubinger | 84/385 P |

*Primary Examiner*—Michael L. Gellner
*Assistant Examiner*—Cassandra C. Spyrou
*Attorney, Agent, or Firm*—Joseph S. Iandiorio

[57] ABSTRACT

A process for evenly seating a woodwind instrument tone hole sealing pad in the pad cup, and the tone hole sealing pad for accomplishing this even seating. The process contemplates placing the pad on the tone hole rim, applying a force to the rim to pull it against the tone hole rim, providing a substance between the pad and the cup for positioning the pad in the cup, and contacting the cup to the pad to position the pad in the cup while the pad is seated against the tone hole rim to provide an even seating cup pad assembly.

30 Claims, 1 Drawing Sheet

PROCESS FOR SEATING A TONE HOLE PAD

FIELD OF INVENTION

This invention relates to a process for evenly seating a woodwind instrument tone hole sealing pad in the pad cup so that the pad properly seals around the entire circumference of the tone hole rim in use.

BACKGROUND OF INVENTION

In order for a woodwind instrument to have accurate sound, it is critical that the tone hole sealing pad make a complete seal flat against the tone hole rim. Since the tone hole rims are almost never perfectly flat, the pads are almost never perfectly flat, and the cup that holds the pad is almost never perfectly flat, the pads must be installed in the cup using shims behind the pad in order to get as close to a sealing fit as possible. The installation is made more difficult by the fact that the cup approaches the tone hole from an angle, making this shimming more guess work than science.

There have been a number of techniques developed in attempts to provide relatively easy installation of pads that properly seal around the entire circumference of the tone hole rim. One method contemplates floating the pads into place on a liquid placed in the cup, which then hardens to serve as a permanent shim between the cup and the pad. In this process, while the pad is floating on the liquid, the installer pushes the pad against the tone hole rim by moving the cup down towards the rim. Ideally, the pad will seat flat against the rim and the liquid will harden, securing the pad in the position necessary in the cup to provide a flat fit of the pad against the rim. Typically, shellac is used as the liquid for floating the pad; the shellac is melted by the application of heat to the cup. Various other adhesives have also been used.

This floating technique suffers from a number of problems. The larger pads for the woodwind instruments having larger tone holes are inherently more flexible than the smaller pads and thus are even more likely not to be flat. Since the traditional floating process relies primarily on pads being flat and rigid, the process does not work well for these large pads. Further, the pad installer must very carefully push the cup against the tone hole rim while seating the pad in the floating process, since there is really no effective way to pull the pad out of the cup once it is pushed into the cup. Sometimes the installer can stick a pin in the side of the pad and lever it back out of the cup, but this procedure can damage the pad skin, is imprecise, and can sometimes leave air bubbles behind the pad which allow the pad to collapse at this point in use. One method that has been developed to move the pad around in the cup while it is being installed in such a manner is to place a shim or slick between the pad and the cup under one section of the pad in order to compensate for some imprecision in the floating process. However, this requires that the operator perform educated guesswork, which is fraught with problems and also requires an experienced and thus expensive installer.

For pads that are held in a cup with a screw and a washer, the pads are typically shimmed with extremely thin pieces of paper placed between the pad and the cup to push the pad forward so that it lies flat against the tone hole rim. This installation is typically accomplished by the installer first applying a single paper shim cut in a desired shape to match as closely as possible the pad to the rim. Then, the pad is pressed against the rim using the instrument keys. The installer can then use a feeler gauge or a light source placed inside the instrument tube to find gaps between the pad and the rim. The installer identifies and marks the location of the gaps, removes the key from the instrument, removes the pad from the cup, and then adds one or more shims to make up for the gaps. The pad is then placed back into the cup, the key is reassembled onto the instrument, and the pad closure is tested again with a feeler gauge or light source. The shimming process is repeated as often as necessary to accomplish the desired seating.

This process suffers from the drawbacks that it is time consuming and depends on the judgment of the installer regarding the location and thickness of paper shims. Since this judgment is experiential, the installer must be skilled, and the process is therefore expensive. Further, the cup surfaces typically are not flat. Accordingly, over time the paper or plastic shims can collapse into the curve of the cup, destroying the flatness that is accomplished with the shims. Another problem with this installation technique is that it requires frequent replacement of the metal screws, washers and/or bushing which hold the pad in place. Since it is nearly impossible to accomplish such replacement in the same way twice, the installer may conclude that a pad is leaking because of improper shimming when in fact the placement or tension of the metal pad holder has altered the position of the pad. Finally, the metal pad holders amplify the noise of the pad striking the tone hole rim and are thus undesirable in good quality instruments.

A third pad installation technique for felt pads contemplates securing the pads in the cups using metal or plastic pad holders that are clamped in place. Steam is then circulated through the body of the instrument to set the tone hole rim impression in the pad. However, this setting is impermanent and thus the pad will have a tendency to return at least partially to its original position, causing the pads to leak. Further, these felt pads are thick and fluffy thus have a spongy feel to the player which is undesirable because the player does not know exactly when the pad is in contact with the tone hole rim. Additionally, pads which can take a deep impression of the tone hole rim create more surface on which the pad can stick to the tone hole rim, making play difficult. The metal pad holders amplify the noise of the pad striking the tone hole rim, making them undesirable. Finally, since the technique requires steam, it cannot be used on instruments made of wood.

SUMMARY OF INVENTION

It is therefore an object of this invention to provide a pad installation technique that is extremely easy to use.

It is a further object of this invention to provide such a technique which insures that the pad is seated against the entire circumference of the tone hole rim.

It is a further object of this invention to provide such a technique which requires very little skill or experience and thus is relatively inexpensive to accomplish.

It is a further object of this invention to provide such a technique which is much faster then existing techniques and is thus less expensive.

It is a further object of this invention to provide such a technique which accomplishes a permanent relationship between the pad and the tone hole rim.

It is a further object of this invention to provide such a technique which automatically accomplishes a proper and consistent pad protrusion from the pad cup after installation.

It is a further object of this invention to provide such a technique which eliminates the need for metal holding washers, screws, and studs thus reducing transmission noise of the pad striking the tone hole rim.

This invention results from the realization that a simple yet extremely effective pad installation technique may be accomplished by applying a downward force to the pad while it is sitting on the tone hole rim, for example by hanging a weight off the pad, and then placing a hardenable material in the cup and pressing the cup against the pad that is seated flat on the tone hole rim to secure the pad in the cup in this position.

This invention may be accomplished in a process for evenly seating a woodwind instrument tone hole sealing pad in the pad cup. The process contemplates placing the pad on the tone hole rim, applying a force to the pad to seat it on the tone hole rim, providing a substance between the pad and the cup for positioning the pad in the cup, and contacting the cup to the pad to position the pad in the cup while the pad is seated against the tone hole rim to provide an even seating cup-pad assembly. The force may be applied to the pad by hanging a weight from the pad or by other means such as pulling down on a wire or thin thread attached to the pad. The weight should be removably attached to the pad by some means such as threading the weight into the pad or into a washer in or on the pad. Preferably, the weight has a shaft which communicates with the back of the pad and is threaded into the central hole in the washer. The shaft may be hollow so that air can escape from behind the pad out through the weight to prevent air bubbles from being entrapped in the liquid in the cup after it solidifies. The weight shaft may have a length chosen so that the cup hits the top of the shaft at a position that provides a desired pad protrusion distance below the cup in the assembled form.

The pad is preferably positioned in the cup with a solidifiable liquid such as a silicone compound or shellac. The liquid is preferably chemically solidifiable, such as is the case with the silicone compound.

Another means of temporarily attaching the weight or force applying member to the pad is by using magnetic attraction. This may be accomplished with a permanent or electromagnetic weight and a magnetic material in or on the pad, for example a metal washer placed on top of the pad in place of the hardened washer in the embodiment described above. The washer, in any case, should be smaller than the tone hole rim so that it does not stiffen the pad in the circumferential area where the pad contacts the rim.

A substance release means may be applied to the cup before the cup is contacted with the pad to facilitate pad removal from the cup at a later time, for example, if the pad needs to be replaced or repaired. The release means may be accomplished, for example, with a mold release agent, a washer, or a thin plastic film.

After assembly is complete, the weight must be removed from the pad. This may be accomplished by unscrewing the weight from the pad, pulling the weight out of the pad, cutting the weight from the pad, disengaging the weight from the pad by application of a chemical compound or heat in instances where the means of adhesion may be broken by a solvent chemical compound or heat, or withdrawing the magnetic weight from the pad.

This invention also features a woodwind tone hole sealing pad assembly which is capable of hanging a weight for seating the pad against the tone hole rim. The assembly includes a compliant pad member with a hole for accepting the weight and hardened washer member having a hole aligned with the pad hole for temporarily securing the weight. The washer may be on or in the pad. Preferably, the washer hole is threaded for accepting a threaded weight, and the washer is smaller than the tone hole to allow the compliant pad to properly seat on the tone hole rim.

DISCLOSURE OF PREFERRED EMBODIMENT

Other objects, features and advantages will occur to those skilled in the art from the following description of a preferred embodiment and the accompanying drawings, in which.

This invention features a woodwind instrument tone hole sealing pad assembly and a method for installing a tone hole sealing pad contemplating placing the pad on the tone hole rim and applying a force to the pad to seat it against the rim and then adhering the pad while seated on the rim in this fashion to the cup to provide a pad which seats flat around the entire circumference of the tone hole rim during play.

Figure 1:
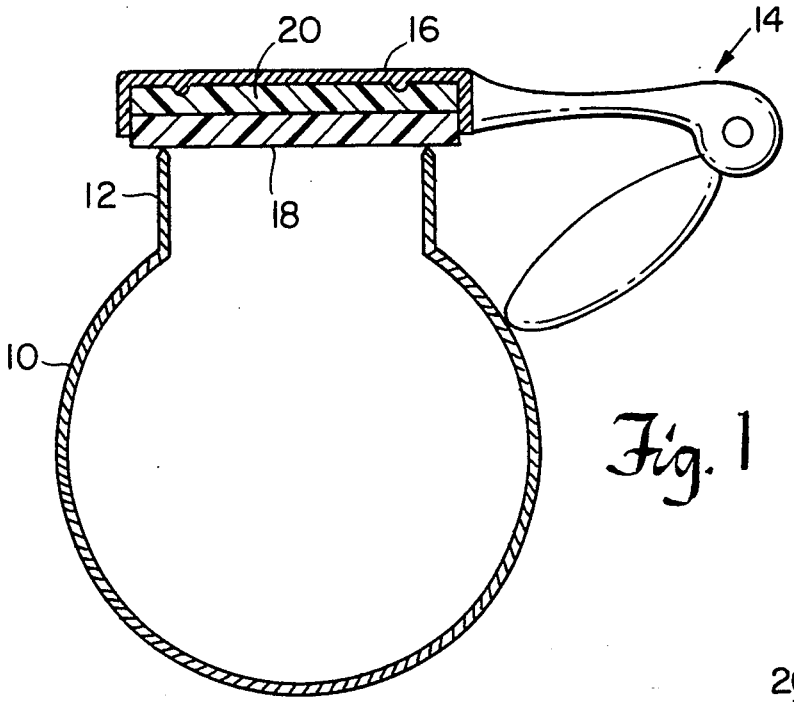
FIG. 1 is a cross sectional view of a flute with a tone hole sealing pad according to this invention installed by the method of this invention.

There is shown in FIG. 1 woodwind instrument such as flute 10 having a tone hole defined by tone hole rim 12. The tone hole is sealed with pad 18 held in cup 16 that is movable on and off of rim 12 by key assembly 14. Substance 20 which is preferably a hardenable liquid substance, is used to retain pad 18 in cup 16 in such a fashion that pad 18 seats flat around the entire circumference of the tone hole 12 and also so that pad 18 protrudes slightly from cup 16 as shown as is desired in quality woodwind instruments. Pad 18 may be any of the known pad types such as silicone, plastic materials, cork, and/or felt.

Figure 2:
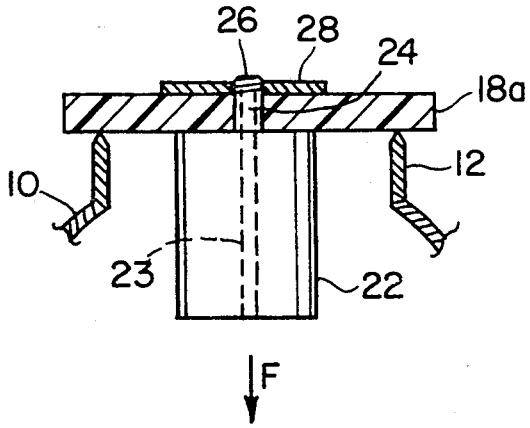
FIG. 2 is a partial cross sectional view of a tone hole sealing pad being installed in a woodwind instrument by the method of this invention.

The method of this invention contemplates placing pad 18*a*, FIG. 2, on tone hole rim 12. When the pad is on top of the tone hole rim as shown, downward force F is applied to pad 18*a* which seats the pad evenly against the tone hole rim. One manner of accomplishing the application of force is to attach weight 22 to pad 18*a*. This attachment may be accomplished, for example, by adhering the weight to the pad using adhesives or magnetism. Preferably, weight 22 is designed with shaft 24 having threaded end 26 that is threadably received within the threaded central hole of washer 28 placed on the upper side of pad 18*a*. In this case, the pad then in effect includes the washer.

A technique which has been successfully employed to assemble flute pads uses a silicone pad 18*a* and a phenolic washer 28 having a thickness of approximately 0.016" tapped with a number 80 thread in its ⅛" diameter hole. This washer thickness supports one or two threads, which is enough to support weight 22. Washer 28 must be larger than the central hole in pad 18*a* through which shaft 24 fits, and is preferably smaller than the diameter of tone hole rim 12 so that the stiffness of washer 28*a* does not detract from the compliance of pad 18*a* in the important sealing section just over rim 12. Washer 28 thus applies the force of weight 22 evenly across a large area of pad 18*a* so that pad 18*a* sits flat around the entire circumference of rim 12 even though pad 18*a* and rim 12 are not perfectly flat.

Any alternative means of applying such a force to push or pull the pad against the rim may be employed in this invention. For example, the washer could be attached to the shaft of the weight with a weakened area, by using a relatively weak washer material, so that the weight can be broken away from the washer after assembly of the cup and pad is complete. Alternatively, the shaft could be attached to the pad or washer using an adhesive substance and the two can be separated by application of a solvent for the adhesive, or heat for an adhesive which melts above room temperature. Another alternative is to use a sacrificial weight shaft 24 that can be cut off at pad level with a razor blade.

Weight 22 may also be applied to pad 18*a* using magnetic attraction. For example, washer 28 can be a magnetic material and weight 22 could either be a permanent or electromagnet. For pads which are molded or made of synthetic materials, magnetic material could be added to the pad material during molding to provide a magnetic pad to which the magnetic weight could be fixed.

Thus, there are many means for temporarily securing a weight or other force-applying mechanism to the pad to seat the pad around the circumference of the tone hole rim. Washer 28 is necessary in most applications as without it weight 22 causes pad 18*a* to bow slightly and not seat flat around rim 12. However, for small pads or relatively stiff pads which do not bow or bow an acceptable amount, washer 28 is unnecessary. Additionally, washer 28 can be employed either on the upper side of pad 18*a* as shown or within the pad as long as it provides a means of temporary mounting a weight to the pad.

Assembly of the cup to the pad assembly is then completed by adhering the pad into the cup while the pad is in position on the tone hole pad as shown in FIG. 2. Preferably, this adhesion is accomplished with a hardenable liquid material such as a silicone compound or shellac, for example. The material is preferably placed in the cup in a liquid or tacky form and then the cup is seated down onto the pad. After the material hardens, the weight is removed.

In the preferred form shown in FIGS. 1 and 2, weight 22 has a central hole 23 passing entirely through the weight and shaft 24. This allows any air trapped behind the pad to escape through the weight. Preferably, weight 22 has male threads which are received within female threads in the hole in washer 28. The floating material is preferably a chemically cured silicone such as RBC 7125 or 7155 silicone cured with fast catalyst 725 or slow catalyst 710, all made by RBC Corporation in Warwick, Rhode Island. The installer presses the cup with the floating material onto the pad until the pad protrudes the correct distance from the cup. After the floating material has set, the weight is unscrewed from washer 28. The hole in the pad can then be easily plugged if desired. This can be accomplished by filling the hole with the silicone compound or inserting a washer into the hole in the pad and using a screw to secure it to a threaded spud previously soldered or glued to the inside of the cup.

The weight can also be used to control the amount of pad protrusion from the cup in the assembled form. This can be accomplished by choosing the length of shaft 24 such that the inside of cup 16 hits the top of the shaft when the pad is protruding the correct distance from the edge of the cup. Using this design, the installer has no need to carefully seat the cup on the pad so that the correct protrusion is accomplished. Rather, the installer need only carefully press the cup down onto the pad until movement is stopped by the shaft of the weight, and then clamp or hold the cup in position until the liquid hardens.

If the pad is made of a material like wool felt which is likely to swell and/or shrink over time, an impression of the tone hole rim can be created in the pads by steaming and clamping to minimize the chances of future leaks around the pad-rim seal. Alternatively, the pad assembly can be made more easily removable from the cup by using a release agent or a barrier washer on the inside of the cup. This could be accomplished with substances such as mold release agents or with barriers such as plastic film which would facilitate the removal of the pad from the cup.

Figure 3:
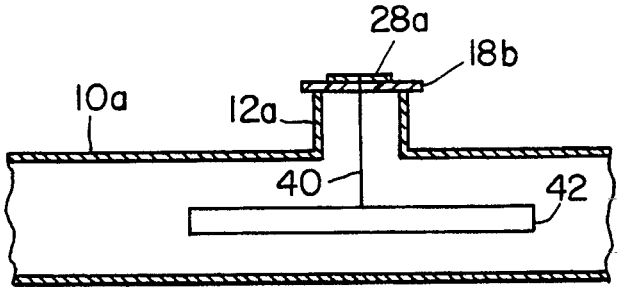
FIG. 3 is a partial cross sectional view of another means of applying a downward force to the pad during the installation method of this invention.

FIG. 3 shows schematically another means of applying force to the pad during the installation process. In this example, pad 18*b* is being seated on tone hole rim 12*a* of instrument 10*a* Wire or thread 40 is attached to washer 28 and passes through pad 18*b* to hang down towards the center of instrument 10*a*. An arbor or another device 42 may then be temporarily attached to wire 40. The weight of member 42 or force applied to member 42 then pulls the pad against the tone hole rim. When the pad has been floated into place in the cup, wire 40 can be cut off at the surface of pad 18*b*. If the pad is made of an elastomeric material, the tiny hole in the pad would not have to be plugged. Air could be allowed to escape from between the pad and cup in this embodiment by making the diameter of the pad slightly less then the inside diameter of the cup so that it is just a little bit loose in the cup to provide a circumferential gap through which air may escape.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A process for evenly seating a woodwind instrument tone hole sealing pad in a pad cup, comprising:

placing the pad with a hole through the pad on the tone hole rim;

providing a hardened washer with the washer's hole aligned with the pad hole;

temporarily securing a weight to the washer to pull the pad down against the tone hole rim;

putting a solidifiable liquid in the cup;

contacting the cup to the pad until the liquid hardens to secure the pad in the cup; and removing the weight from the pad to provide an even seating cup-pad assembly.

2. A process for seating the bottom of a tone hole pad on a tone hole rim and for seating the top of the pad within a pad cup, comprising:

placing the pad on the tone hole rim without the cup;

attaching a mass to the pad to urge the pad to seat on the tone hole rim without the cup;

placing an adhesional substance between the top of the pad and the cup;

bringing the cup down onto the pad;

allowing the adhesional substance to cure; and removing the mass from the pad.

3. The process of claim 2 further including placing a washer on the pad.

4. The process of claim 3 in which the washer has a threaded hole for accepting the mass.

5. The process of claim 4 in which attaching the mass includes threading the mass into the washer.

6. The process of claim 2 in which the mass includes a shaft for communicating with the top of the pad.

7. The process of claim 6 in which the shaft is hollow to allow air to escape from the top of the pad through the mass.

8. The process of claim 6 further including setting the shaft length to extend through the pad to contact the cup when the cup is brought down on the pad a desired distance for providing a predetermined pad protrusion from the cup.

9. The process of claim 2 in which placing an adhesional substance includes placing a solidifiable liquid in the cup.

10. The process of claim 9 in which the liquid is a silicone compound.

11. The process of claim 9 in which the liquid is chemically solidifiable.

12. The process of claim 9 in which the liquid is a shellac.

13. The process of claim 2 in which attaching the mass to the pad includes magnetically attracting the mass to the pad.

14. The process of claim 13 in which the pad includes a magnetic material for attracting a magnetized mass.

15. The process of claim 14 in which the magnetic material includes a piece of magnetic material on the pad.

16. The process of claim 14 in which the magnetic material includes a piece of magnetic material in the pad.

17. The process of claim 3 in which the washer is smaller than the tone hole to allow the pad to properly seat on the tone hole rim.

18. The process of claim 2 further including applying a substance release means to the cup before contacting the cup to the pad to facilitate later removal of the pad from the cup.

19. The process of claim 2 in which removing the mass includes pulling the mass out of the pad.

20. The process of claim 2 in which removing the mass includes cutting the mass from the pad.

21. The process of claim 2 in which attaching the mass includes adhering the mass to the pad.

22. The process of claim 21 in which removing the mass includes disengaging the mass from the pad by application of a chemical compound or heat.

23. A process for seating a woodwind instrument tone hole sealing pad in a pad cup so that the pad evenly contacts a tone hole rim, comprising:

placing the pad on the tone hole rim without the cup;

applying a temporary force to the pad to seat the pad on the tone hole rim without the cup;

providing an adhesional substance between the pad and the cup for securing the pad in the cup;

contacting the cup tot he pad to position and to secure the pad in the cup and to provide an even seating cup-pad assembly; and removing the temporary force applied to the pad.

24. The process of claim 23 in which applying a temporary force includes removably attaching a mass to the pad.

25. The process of claim 24 in which said mass is attached to the pad by a wire protruding down from the pad.

26. A seating system for seating a woodwind instrument tone hole sealing pad in a pad cup so that the pad evenly contacts the tone hole rim of the instrument, comprising:

a tone hole sealing pad;

a pad cup;

a tone hole rim;

a mass; and means for temporarily urging said tone hole sealing pad to seat on said tone hole rim without said cup, including means for removeably attaching said mass to hang from said tone hole sealing pad.

27. The seating system of claim 26 in which said pad includes a central hole, and said means for removeably attaching includes a washer having a threaded hole aligned with said central hole.

28. The seating system of claim 27 in which said mass includes a a threaded portion receivable through said central hole of said pad and by said washer.

29. The process of claim 27 in which the washer is smaller than the tone hole to allow the pad to properly seat on the tone hole rim.

30. The seating system of claim 26 further comprising a washer and in which said means for removably attaching said mass to said tone hole sealing pad includes a wire attached to said mass on one end and attached to said washer on an opposite end, said washer located on top of said sealing pad and said wire passing through said sealing pad.

* * * * *